US008615319B2

(12) United States Patent
Felice

(10) Patent No.: US 8,615,319 B2
(45) Date of Patent: Dec. 24, 2013

(54) INTERACTIVE KNITTING AND CROCHETING SYSTEM

(76) Inventor: Karen Felice, Thunder Bay (CA)

( * ) Notice: Subject to any disclaimer, the term of this patent is extended or adjusted under 35 U.S.C. 154(b) by 398 days.

(21) Appl. No.: 13/109,118

(22) Filed: May 17, 2011

(65) Prior Publication Data

US 2012/0296465 A1 Nov. 22, 2012

(51) Int. Cl.
*G06F 19/00* (2011.01)
*D04B 3/02* (2006.01)

(52) U.S. Cl.
USPC ..... 700/141; 66/1 A; 66/117; 66/118

(58) Field of Classification Search
USPC ..... 66/1 R, 1 A, 116, 117, 118, 119–124; 700/141, 131, 112, 13
See application file for complete search history.

(56) References Cited

U.S. PATENT DOCUMENTS

| | | | |
|---|---|---|---|
| 2,486,184 | A | 10/1949 | Maker |
| 4,343,160 | A | 8/1982 | Ponthus born Turquet |
| D271,062 | S | 10/1983 | Okada |
| 4,608,642 | A | 8/1986 | Shima |
| 7,574,876 | B2 | 8/2009 | Goldschmidt |
| 2008/0003546 | A1 | 1/2008 | Dunbar et al. |

*Primary Examiner* — Danny Worrell
(74) *Attorney, Agent, or Firm* — Kyle Fletcher

(57) ABSTRACT

The interactive knitting and crocheting system includes at least one crocheting or knitting needle with a motion-based sensing capability integrated therein and a computing means. The computing means monitors movement of the respective needle to monitor proper crocheting or knitting technique, and upon detection of improper technique will provide an alert that an error has occurred, which shall prevent waste in work. The computing means provides notice of improper technique in the form of an audiovisual means, which can double as an instructional aid in teaching how to crochet or knit. The computing means also provides progress as to the stitch and pattern formed.

24 Claims, 6 Drawing Sheets

FIG. 6
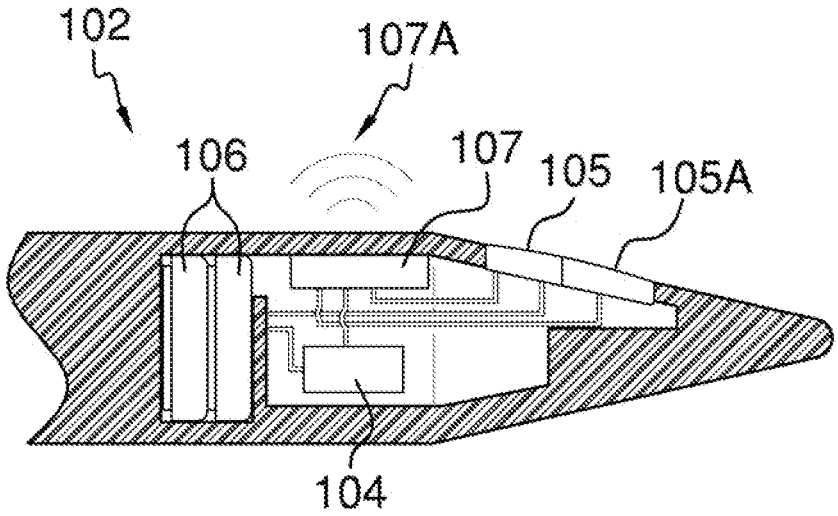
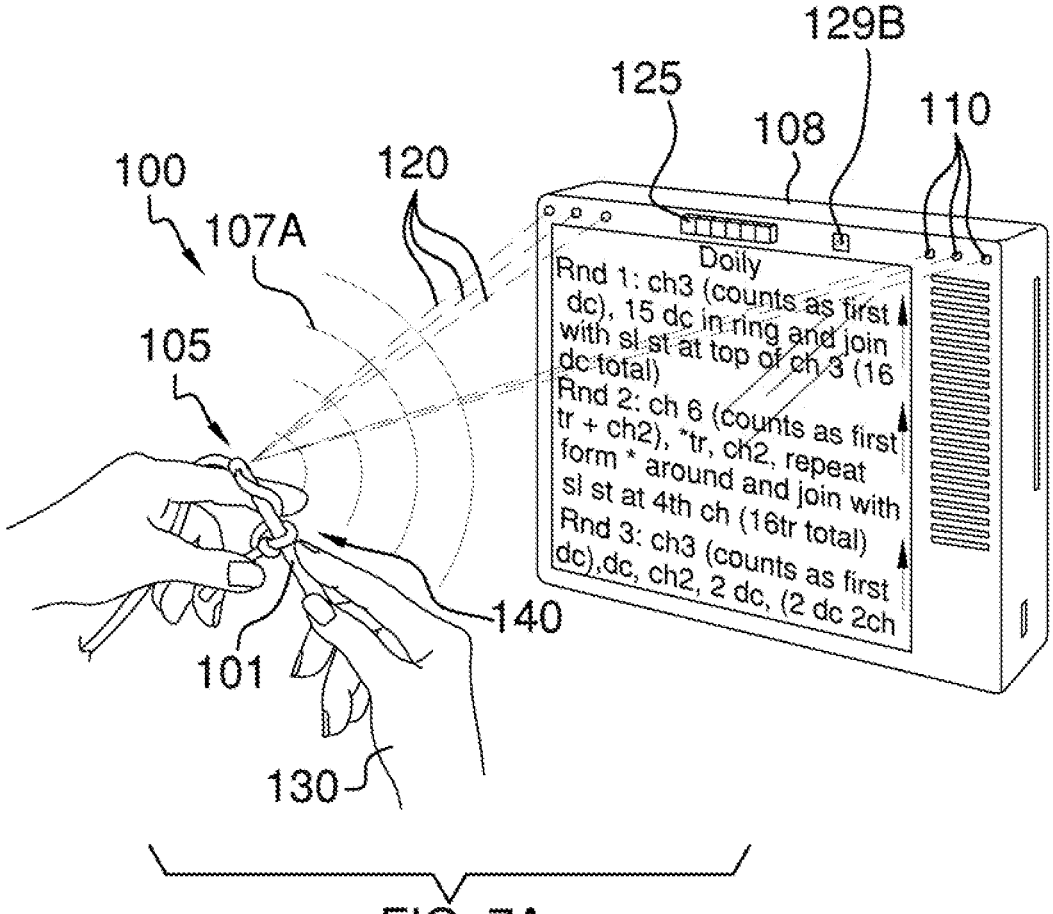
FIG. 7A

INTERACTIVE KNITTING AND CROCHETING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

1. Field of the Invention

The present invention relates to the field of knitting and crocheting, more specifically, an interactive system that, monitors proper technique and insures that no errors are overlooked.

Knitting and Crocheting is a time old tradition that requires a lot of time and patience. In performing either knitting and crocheting, an accidental omission in making a stitch or loop can result in undoing rows worth of work, which can waste time and frustrate the person knitting or crocheting.

Motion-based sensing technology has been used extensively in the gaming industry to provide an interactive gaming experience. Motion-based sensing employs the use of at least one accelerometer to detect rotational movement. Motion-based sensing also uses a light sensor mounted on the object being a series of infrared lights that are located at pre-defined distances with respect to one another. Through the use of accelerometry and triangulation, the position-distance-motion can be calculated.

A need exist to provide a sensory system that is integrated into the needle or needles, which detects and counts each stitch, loop, or row to ensure that the proper pattern is being formed on the item that is being knitted or crocheted. An additional need is to provide a sensor, that not only provides simultaneous feedback as to the progress of the item being knitted or crocheted, but also notifies the person when an omission has occurred, and additionally provides instantaneous feedback and instruction as to proper technique.

2. Discussion of the Prior Art

As a preliminary note, it should be stated that there is an ample amount of prior art that deals with crocheting and knitting generally. As will be discussed immediately below, no prior art discloses a needle or a pair of needles that include motion-based sensor technology that are monitored with a computing means to detect and monitor proper crocheting and knitting technique; wherein the computer provides instantaneous feedback in the form of notice to an omitted loop or stitch as well as the progress of the pattern being formed; wherein the computing means provides instantaneous feedback, instruction, and/or progress of the pattern being formed as to knitting or crocheting technique via audiovisual means.

The Turquet Patent (U.S. Pat. No. 4,343,160) discloses a row counting apparatus that is integrated into the tip or handle of a knitting needle. However, the counting apparatus does not teach the use of a virtual based sensing technology to detect position, motion, and distance of an object in order to monitor proper knitting or crocheting technique.

The Goldschmidt Patent (U.S. Pat. No. 7,574,876) discloses a battery powered electronic knitting needle with illumination. However, the needle is only directed to illumination and not motion sensing of the needle that is monitored via a computing means to determine proper knitting or crocheting technique.

The Maker et al. Patent (U.S. Pat. No. 2,486,184) discloses an adjustable knitting needle with thread type and size indicator. However, the knitting needle does not work with a computing means to determine proper stitching, looping, or row forming.

The Shima Patent (U.S. Pat. No. 4,608,642) discloses a computerized knitting machine in which a pattern can be recorded into the device. However, the knitting machine performs the process of forming the knitted object, and is not a manually operated needle that is monitored by a computing means to ensure proper technique is performed.

The Dunbar et al. Patent Application Publication (U.S. Pub. No. 2008/0003546) discloses a system for providing digital electronic yarns craft instructions and patterns in which different patterns can be selected. However, the system does not monitor progress of a knitted article via motion based sensing technology integrated into the needle(s) so as to provide notice of an error as it occurs in order to prevent undoing of rows upon later discovery.

While the above-described devices fulfill their respective and particular objects and requirements, they do not describe a needle or a pair of needles that include motion-based sensor technology that are monitored with a computing means to detect and monitor proper crocheting and knitting technique; wherein the computer provides instantaneous feedback in the form of notice to an omitted loop or stitch as well as the progress of the pattern being formed; wherein the computing means provides instantaneous feedback, instruction, and/or progress of the pattern being formed as to knitting or crocheting technique via audiovisual means. In this regard, the interactive knitting and crocheting system departs from the conventional concepts and designs of the prior art.

SUMMARY OF THE INVENTION

The interactive knitting and crocheting system includes at least one crocheting or knitting needle with a motion-based sensing capability integrated therein and a computing means. The computing means monitors movement of the respective needle to monitor proper crocheting or knitting technique, and upon detection of improper technique will provide an alert that an error has occurred, which shall prevent waste in work. The computing means provides notice of improper technique in the form of an audiovisual means, which can double as an instructional aid in teaching how to crochet or knit. The computing means also provides progress as to the stitch and pattern formed.

An object of the invention is to provide a motion-based needle that is monitored via a computing means to determine proper crocheting or knitting technique.

A further object of the invention is to provide a needle with a motion-based sensing capability comprised of at least one accelerometer and an optical sensor, which works in conjunction with an infrared display located on the audiovisual means.

A further object of the invention is to provide a system that monitors proper technique and provides notice town error so as to prevent wasted time and work from continuing after an error has occurred.

A further object of the invention is to provide a motion-based system that doubles as an instructional aid in teaching how to properly knit or crochet.

An even further object of the invention is to provide a computing means that displays the progress of the pattern that the end user is to follow whether knitting or crocheting.

An even further object of the invention is to enable the computing means to monitor that the proper stitches are being formed pursuant to the desired pattern, and alert the end user of any error should it occur.

These together with additional objects, features and advantages of the interactive knitting and crocheting system will be readily apparent to those of ordinary skill in the art upon reading the following detailed description of presently preferred, but nonetheless illustrative, embodiments of the interactive knitting and crocheting system when taken in conjunction with the accompanying drawings.

In this respect, before explaining the current embodiments of the interactive knitting and crocheting system in detail, it is to be understood that the interactive knitting and crocheting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the interactive knitting and crocheting system.

It is therefore important that the claims be regarded as including such equivalent construction insofar as they do not depart from the spirit and scope of the interactive knitting and crocheting system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 6 illustrates a cross-sectional view of the knitting needle along line 4-4 in FIG. 2, and depicting the powering means, the transmitter, the light sensor, and the accelerometer;

FIG. 7A illustrates the crochet needle in use with the audiovisual means;

DETAILED DESCRIPTION OF THE EMBODIMENT

Figure 1:
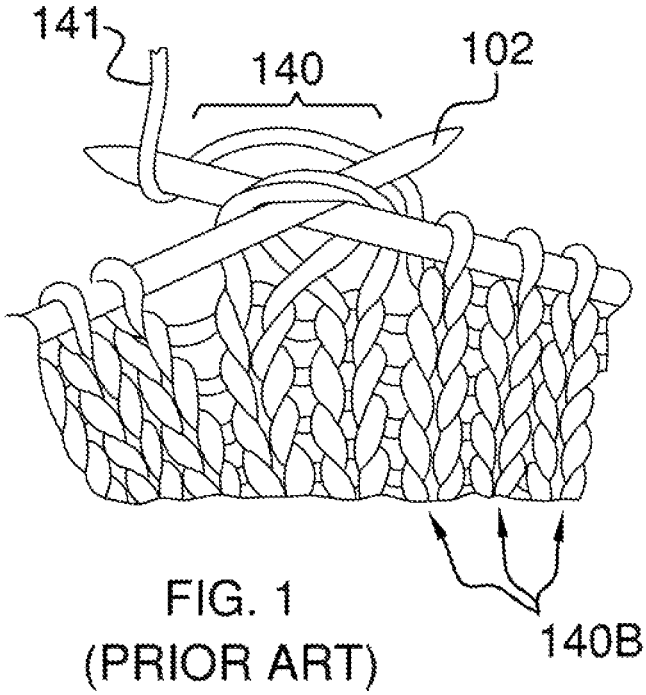
FIG. 1 (PRIOR ART)
FIG. 1 illustrates a stitch being formed on two knitting needles in which the rows and columns are attached at a first side on the respective knitting needles, and is included as it pertains to prior art.
Figure 2:
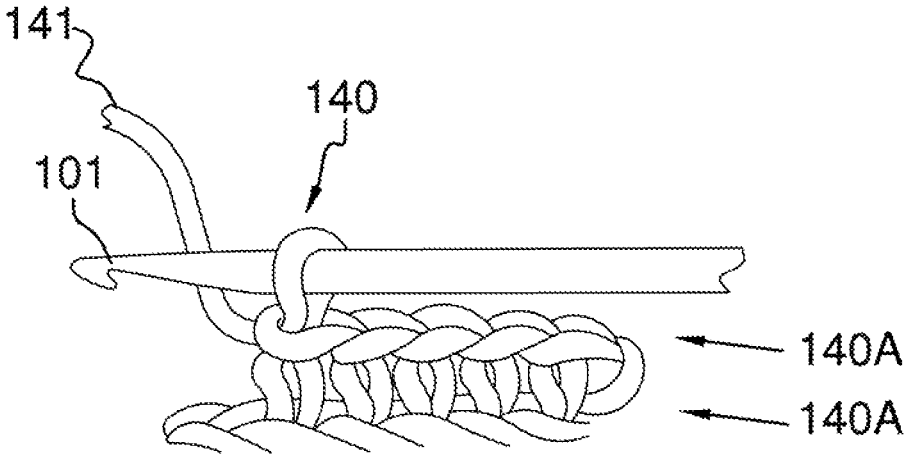
FIG. 2 (PRIOR ART)
FIG. 2 illustrates a single stitch being formed via a crochet hook and in which the object being stitched hangs from below the crochet hook.
Figure 3:
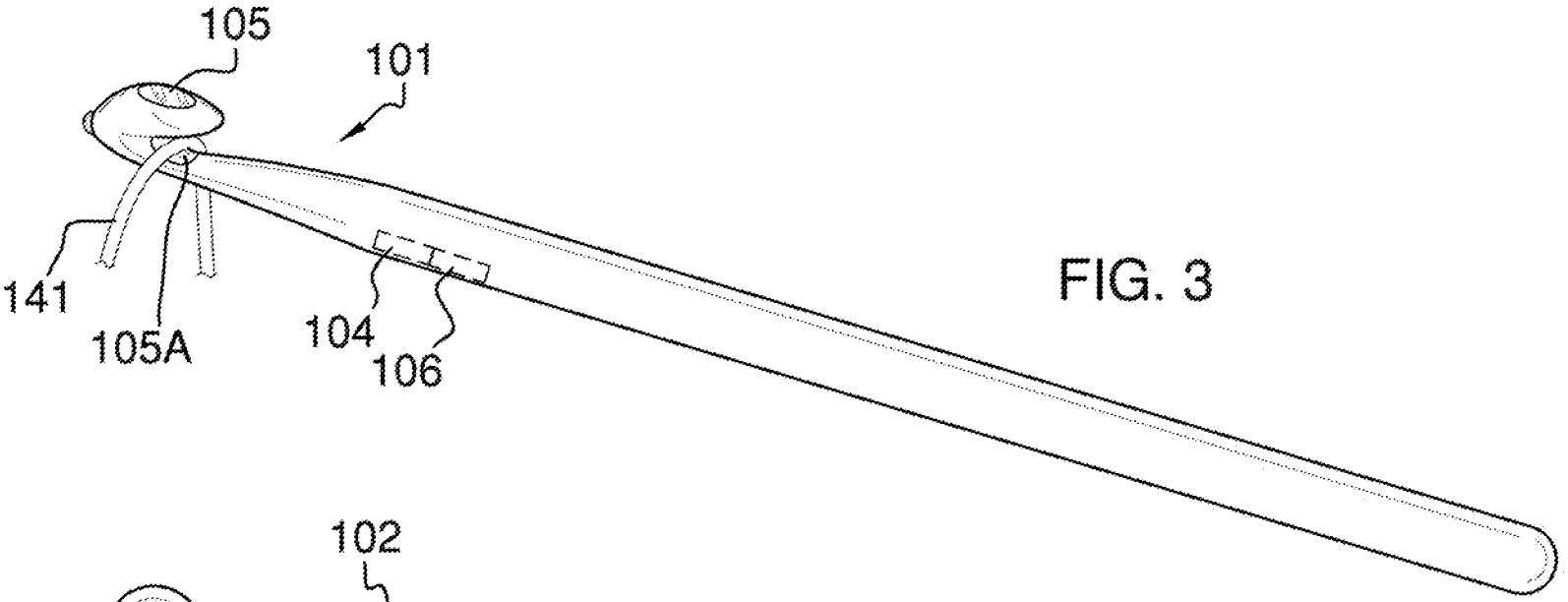
FIG. 3 illustrates an isometric view of a crochet hook in which the accelerometer is depicted in dashed lines.
Figure 4:
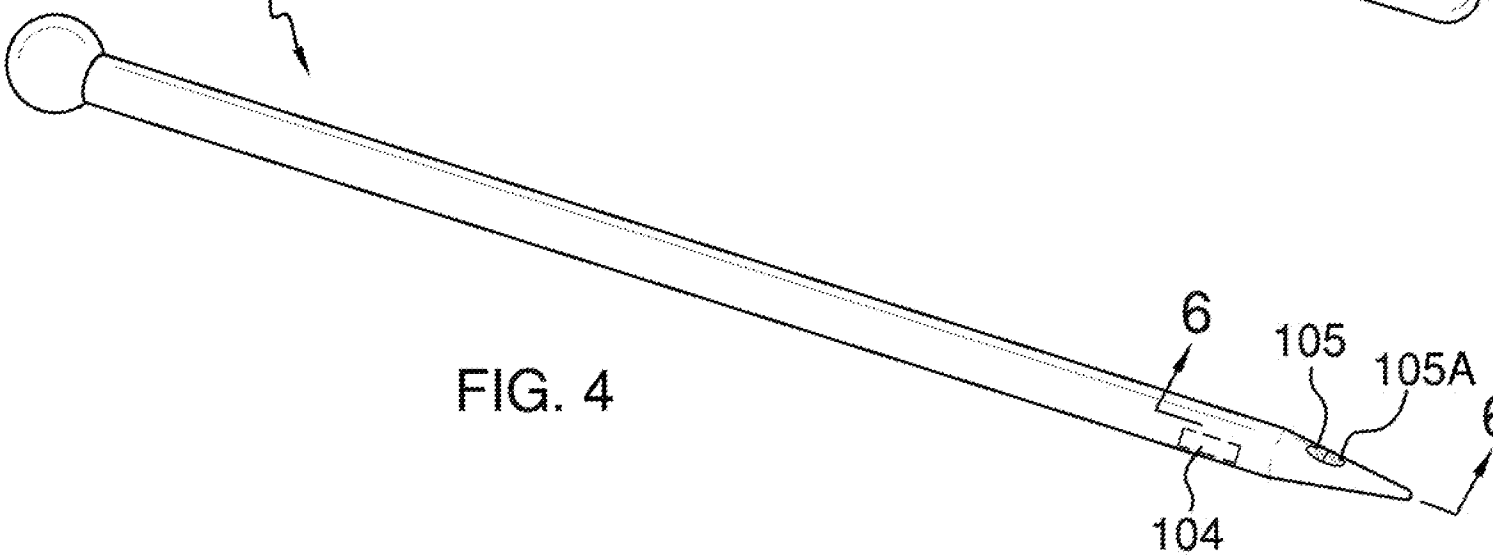
FIG. 4 illustrates an isometric view of a knitting needle in which the accelerometer is depicted in dashed lines.
Figure 5:
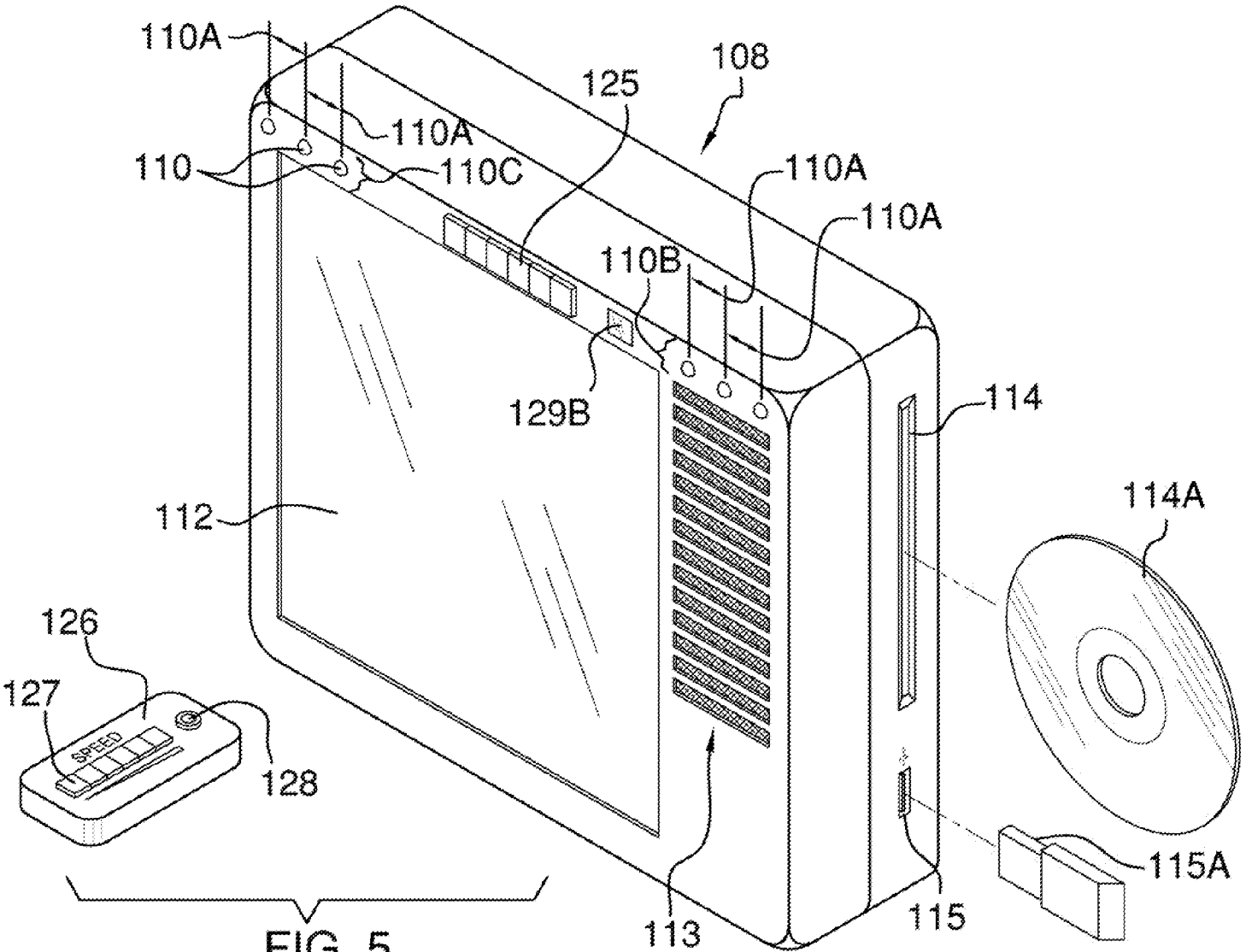
FIG. 5 illustrates a view of the audiovisual means in which a plurality of infrared lights are aligned across a top and a CD drive in which a CD is aligned therewith as well as a USB drive aligned adjacent a USB port as well as a remote control to adjust speed of the stitching pattern.

The following detailed description is merely exemplary in nature and is not intended to limit the described embodiments of the application and uses of the described-embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 3-8. An interactive knitting and crocheting system 100 (hereinafter invention) includes a crochet hook 101 and at least two knitting needles 102.

As a preliminary matter it shall be noted that the difference between crochet and knitting is that an end user 130 uses the crochet hook 101 to form a single stitch 140 whereas at least two knitting needles 102 are used in order to form a stitch 140 and the rows and columns are defined along a length of the respective knitting needle 102.

Located in the crochet hook 101 and the knitting needles 102 is a motion-sensor capability 103, which includes an accelerometer 104, a light sensor 105, a powering means 106, and a transmitter 107. The accelerometer 104 and the light sensor 105 are located at or near a tip end 101A of the crochet hook 101 or a tip end 102A of the knitting needle 102, respectively.

An audiovisual means 108 is included with the invention 100 and further includes a computing means 109 (hereinafter microprocessor), a plurality of infrared lights 110, a receiver 111, a visual display 112, at least one speaker 113, a CD drive 114, and a USB drive 115.

The motion-sensor capability 103 works in concert with the microprocessor 109 in order to calculate distance, rotational movement, and location of the crochet needle 101 or the knitting needles 102 with respect to itself or one another, depending upon whether the end user 130 is crocheting or knitting. The motion-sensor capability 103 uses the light sensor 105 to detect the distance and location of the respective needle 101/102 with respect to the infrared lights 110 by employing an algorithm involving triangulation, which is well known in the art. The algorithm is exemplified physically with lines of triangulation 120 depicted in FIGS. 7A and 7B. The infrared lights 110 are divided into two groups 110B and 11C. The only constant when calculating the location and distance is that an infrared distance 110A exists between the groups 110B and 110C of the infrared lights 110 located on each side of the audiovisual means 108. The light sensor 105 transmits the sensing of infrared lights 110 to the microprocessor 109 via the transmitter 107.

The motion-sensor capability 103 also relies upon the output of the accelerometer 104 to determine rotational movement or translational movement of the respective needle 101/102 via the transmitter 107. The transmitter 107 emits a signal 107A that is received by the receiver 111, which is then transferred to the microprocessor 109 for analysis.

The algorithm maps three-dimensional movement of the respective needle(s) 101/102 and compares said movement to a stitch identifier 121 and stitch/row counter 122 to ensure proper stitching formation and procedure. The microprocessor 109 uses data supplied to compare the three-dimensional movement, and provide notice when an error has occurred and/or to provide an audiovisual representation that can instruct the end user 130 to proper technique.

Said data can be in the form of a DVD 114A or a USB flash drive 115A. Said data provided via the DVD 114A or the USB flash drive 115A may involve programs designed to monitor and teach different styles stitches formed via the crochet hook 101 or knitting needles 102 as well as to provide a pattern the end user shall follow to create the desired end product. Said data can provide the microprocessor 109 with the proper technique and instruction pertaining to counting not only stitches 140, but also rows 140A, and/or columns 140B, and/or the rate of progress of the end product. Even more importantly, said data can provide the end user 130 with instruction as to the different styles of stitches 140 involved, and may comprise a purl stitch for knitting, a garter stitch for knitting, a slip stitch for crocheting, a single crochet stitch, and other styles of stitches that are well known in the art.

Figure 7B:
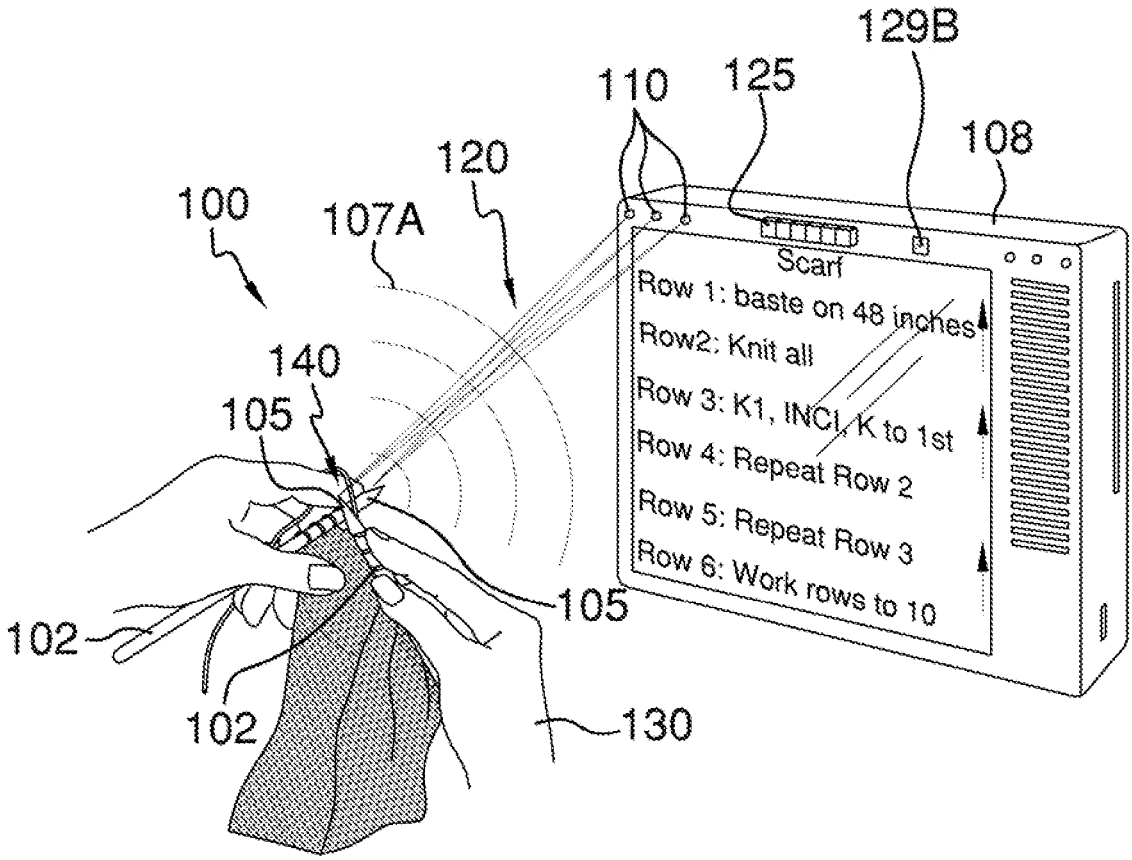
FIG. 7B illustrates two knitting needles in use with the audiovisual means.

Referring to FIGS. 7A-7B, said data may provide a list of instructions that the end user 130 follows in chronological order in order to create the desired end product. For example, in FIG. 7A, the visual display 112 describes the end product as "DOILY", and begins with Rnd 1: ch3 . . . , which is a first instruction that the end user 130 shall follow to commence to crochet said doily. As the end user creates each crochet stitch, the microprocessor compares the actual progress of the end user with the proscribed plan that is stored on either the DVD 114A or the USB flash drive 115A. Should the end user 130 mess up, the invention 100 will emit an alarm to the effect that the end user 130 messed up so that the end user 130 can fix said error and continue along with the proper sequence in order to finish the doily.

Referring to FIG. 7B, the end user 130 is knitting a scarf, which is listed on the visual display 112. Again, as the end user 130 performs the stitches 140 in accordance with the proscribed plan that is listed on the visual display 112, the visual display 112 will scroll down along with the actual progress of the end user 130.

The invention 100 includes an additional feature that is important to the overall function of the invention 100, and is in the form of a speed control 125. The speed control 125 includes a plurality of speed control buttons 125 that are located on the audiovisual means 108. The speed control buttons 125 enable selection of a desired speed with which the end user 130 shall follow along the proscribed plan in order to knit or crochet the desired end product. The speed control 125 involves a plurality of speeds that range from a slow rate of progress for an entry-level knitter/crocheter to a fast rate of progress for an expert knitter/crocheter.

The speed control 125 may include a remote control 126 that includes buttons 127 that correspond to the speed control buttons 125 adjacent the audiovisual means 108. The remote control 126 may also include an on/off button 128 that enables the invention 100 to be turned on or off remotely. More the point, the remote control 126 provides greater ease of use of the invention 100 such that the end user 130 does not have to be in reaching length of the speed control buttons 125 located adjacent the visual display 112.

Figure 8:
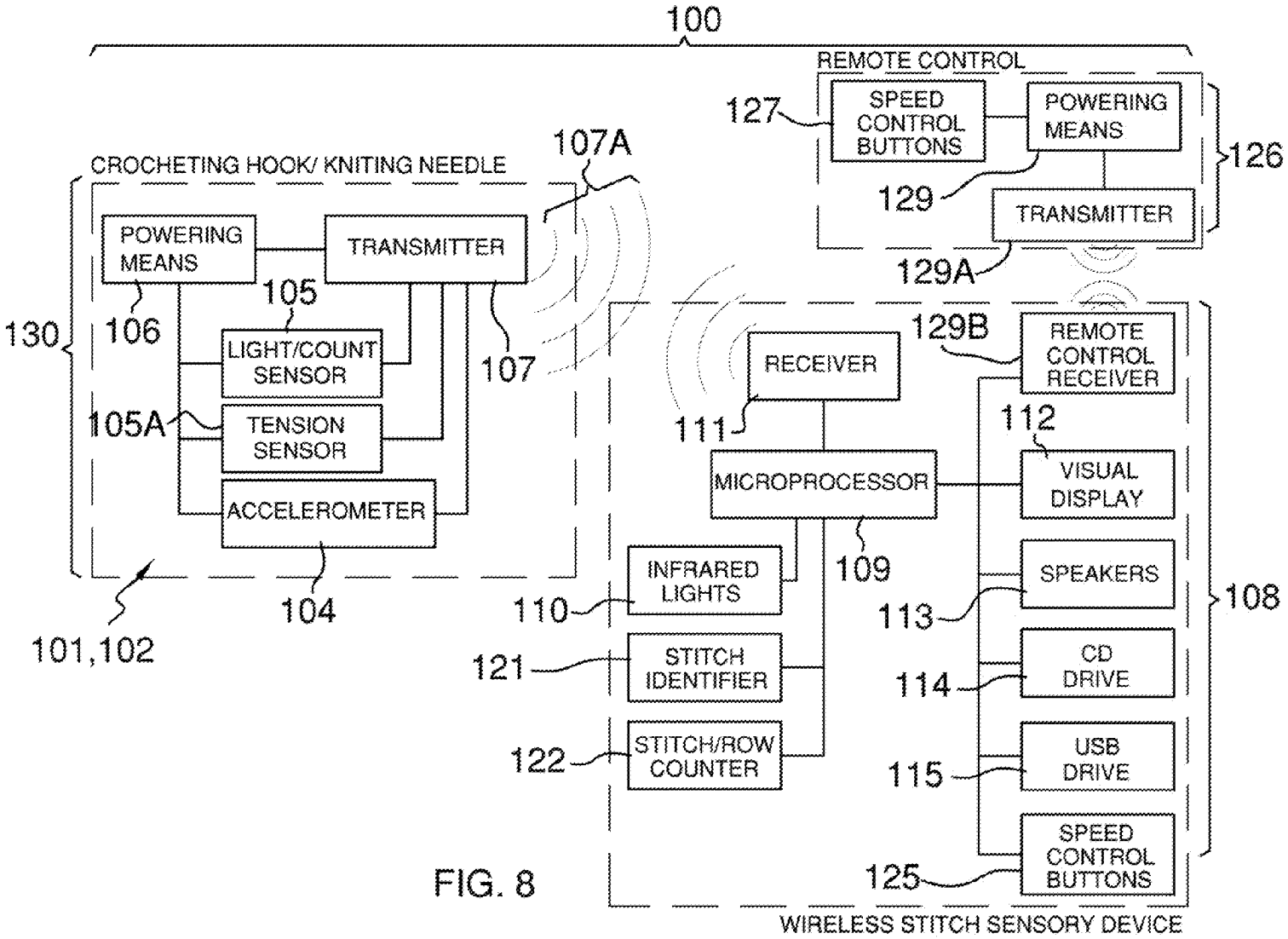
FIG. 8 illustrates a diagram of the various components of the interactive knitting and crocheting system.

Referring to FIG. 8, the remote control 126 includes a powering means 129 wired between a transmitter 129A and both the speed control buttons 127 as well as the on/off button 128. The transmitter 129A wireless communicates to a remote sensor 129B located on the audiovisual means 108.

The speed control 125 simply inputs to the microprocessor 109 the rate of advancement of each stitch that shall be completed within a predefined amount of time so as to create a rate of progress. The speed control adjusts the rate of progress so as to conform to the level of skill of the end user 130.

It shall be noted that in addition to the proscribed plan that is displayed on the visual display 112, an audio program may accompany the wording of the proscribed plan on the visual display 112. The speakers 113 can emit an audible voice of pre-recorded speech that audible recites the wording of the proscribed plan from the visual display 112. The use of audio enables the end user 130 to focus on his/her hands instead of the visual display 112, which may be desirable to the end user 130 when taking skill level into consideration. The use of audio from the pre-recorded speech need only be stored on the DVD 114A or USB flash drive 115A.

Located on the crochet hook 101 or the needle 102 may be a tension sensor 105A. The tension sensor 105A may be added to the invention 100 in order to provide an additional feature to the functionality of the invention 100. More particularly, the tension sensor 105A detects the tension formed between the needle/crochet hook 101/102 and yarn 141 forming the stitch 140. The tension sensor 105A monitors the tension on the yarn 141, which will determine the size and shape of the stitch 140 formed. It shall be noted that if the tension on the yarn 141 varies from stitch to stitch, then the relative uniformity of the pattern formed will be inconsistent, which is not desirable.

That being said, the tension of the yarn 141 needs to be monitored, and needs to be consistent throughout. The tension sensor 105A relays the data collected on each stitch 140 formed, and transmits said data to the microprocessor 109 via the transmitter 107 and the receiver 111. Should the microprocessor 109 receive data indicating inconsistent tension of the yarn 141 from stitch to stitch, the microprocessor 109 may emit an alarm in the form of an audio and/or visual alarm via the audiovisual means 108.

The tension sensor 105A may be of a tactile type sensor, which is well known in the art. A tactile sensor uses no moving parts, but rather a piezoresistive or piezoelectric material, that upon imparting a force onto the surface of said material will transmit an electric signal that can be calculated to determine the tension applied onto said surface. It is important that the tension sensor 105A not involve moving parts as it will encumber the overall use of the invention 100 by making the crochet hook 101 or knitting needle 102 heavier and more bulky.

The tension sensor 105A is depicted as being located near the interior of the hook portion of the crochet hook 101 and near the tip of the knitting needle 102. The location of the tension sensor 105A is important to ensure that the yarn 141 passes over the tension sensor 105A, which can emit the necessary signal for the microprocessor 109 to monitor, and track to ensure that the tension of the yarn 141 in forming the stitch 140 is consistent.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. An interactive knitting and crocheting system, further comprising:

a crochet hook or at least two knitting needles in which a motion-sensor is integrated in said crochet hook or at least two knitting needles;

wherein said motion-sensor is monitored via a computing means to determine proper stitch forming technique;

wherein an audiovisual means alerts an end user to an improper stitch formed upon detection via the motion sensor and computing means;

wherein the audiovisual means provides an instructional aid in teaching proper stitch formation.

2. The interactive knitting and crocheting system as described in claim 1 wherein the motion-sensor comprises a light sensor and an accelerometer located in a tip end of the crochet hook and knitting needles.

3. The interactive knitting and crocheting system as described in claim 2 wherein the light sensor tracks infrared lights located on said audiovisual means to determine distance and location of the crochet hook and knitting needles with respect to the audiovisual means.

4. The interactive knitting and crocheting system as described in claim 3 wherein the infrared lights are aligned in groupings on each side of the audiovisual means; wherein within each infrared light is separated by an infrared distance from an adjacent infrared light of the same group.

5. The interactive knitting and crocheting system as described in claim 4 wherein the accelerometer tracks rotational and translation movement of the crochet hook and knitting needles.

6. The interactive knitting and crocheting system as described in claim 5 wherein the accelerometer and the light sensor are wired to a transmitter that transmits a signal received by a receiver; wherein the receiver is wired to the computing means; wherein the computing means tracks the three-dimensional movement of the crochet hook or knitting needles, and upon detection of an error shall render a notice.

7. The interactive knitting and crocheting system as described in claim 6 wherein the notice is in the form of an audiovisual representation of the improper stitch performed.

8. The interactive knitting and crocheting system as described in claim 7 wherein the audiovisual means includes a visual display and at least one speaker.

9. The interactive knitting and crocheting system as described in claim 8 wherein the computing means is wired to a CD drive or a USB drive such that data pertaining to instructional audiovisual involving proper technique as to different styles of stitches may be supplied; wherein said data may provide a proscribed plan consisting of a plurality of instructions that when completed form an end product; wherein the proscribed plan is listed on the visual display in writing.

10. The interactive knitting and crocheting system as described in claim 9 wherein the proscribed plan may be delivered in audible form via the speaker in conjunction with the writing listed on the visual display.

11. The interactive knitting and crocheting system as described in claim 9 wherein the computing means uses a stitch identifier and stitch/row counter as a means of comparing proper stitch technique; wherein the computing means compares the actual progress formed with the crochet hook or needles and yarn to the proscribed plan, and insures that the proper stitch is formed in accordance with the proscribed plan.

12. The interactive knitting and crocheting system as described in claim 11 wherein a speed control is provided, which can adjust the rate of progress of the stitches formed via the crochet hook or needles; wherein the speed control includes a plurality of buttons located on the audiovisual means that provides a range of speed with which the proscribed plan is completed.

13. The interactive knitting and crocheting system as described in claim 12 wherein a remote control includes a plurality of speed control buttons that enable remote designation of speed provided on the audiovisual means.

14. The interactive knitting and crocheting system as described in claim 9 wherein a tension sensor is located on the crochet hook or the needle, and monitors the tension created between the yarn and the crochet hook or needle; wherein the tension sensor transmits the tension sensor to the audiovisual means wherein the microprocessor shall emit an alarm upon detection of inconsistent tension sensing.

15. An interactive knitting and crocheting system, further comprising:

a crochet hook or at least two knitting needles in which a motion-sensor is integrated in said crochet hook or at least two knitting needles;

wherein said motion-sensor is monitored via a computing means to determine proper stitch forming technique;

wherein an audiovisual means alerts an end user to an improper stitch formed upon detection via the motion sensor and computing means;

wherein the audiovisual means provides an instructional aid in teaching proper stitch formation;

wherein the motion-sensor comprises a light sensor and an accelerometer located in a tip end of the crochet hook and knitting needles;

wherein the light sensor tracks infrared lights located on said audiovisual means to determine distance and location of the crochet hook and knitting needles with respect to the audiovisual means;

wherein the infrared lights are aligned in groupings on each side of the audiovisual means; wherein within each infrared light is separated by an infrared distance from an adjacent infrared light of the same group;

wherein the accelerometer tracks rotational and translation movement of the crochet hook and knitting needles.

16. The interactive knitting and crocheting system as described in claim 15 wherein the accelerometer and the light sensor are wired to a transmitter that transmits a signal received by a receiver; wherein the receiver is wired to the computing means; wherein the computing means tracks the three-dimensional movement of the crochet hook or knitting needles, and upon detection of an error shall render a notice.

17. The interactive knitting and crocheting system as described in claim 16 wherein the notice is in the form of an audiovisual representation of the improper stitch performed.

18. The interactive knitting and crocheting system as described in claim 17 wherein the audiovisual means includes a visual display and at least one speaker.

19. The interactive knitting and crocheting system as described in claim 18 wherein the computing means is wired to a CD drive or a USB drive such that data pertaining to instructional audiovisual involving proper technique as to different styles of stitches may be supplied; wherein said data may provide a proscribed plan consisting of a plurality of instructions that when completed form an end product; wherein the proscribed plan is listed on the visual display in writing.

20. The interactive knitting and crocheting system as described in claim 19 wherein the proscribed plan may be delivered in audible form via the speaker in conjunction with the writing listed on the visual display.

21. The interactive knitting and crocheting system as described in claim 19 wherein the computing means uses a stitch identifier and stitch/row counter as a means of comparing proper stitch technique; wherein the computing means compares the actual progress formed with the crochet hook or needles and yarn to the proscribed plan, and insures that the proper stitch is formed in accordance with the proscribed plan.

22. The interactive knitting and crocheting system as described in claim 21 wherein a speed control is provided, which can adjust the rate of progress of the stitches formed via the crochet hook or needles; wherein the speed control includes a plurality of buttons located on the audiovisual means that provides a range of speed with which the proscribed plan is completed.

23. The interactive knitting and crocheting system as described in claim 22 wherein a remote control includes a plurality of speed control buttons that enable remote designation of speed provided on the audiovisual means.

24. The interactive knitting and crocheting system as described in claim 19 wherein a tension sensor is located on the crochet hook or the needle, and monitors the tension created between the yarn and the crochet hook or needle; wherein the tension sensor transmits the tension sensor to the audiovisual means wherein the microprocessor shall emit an alarm upon detection of inconsistent tension sensing.

* * * * *